US005972197A

United States Patent [19]

Andoh et al.

[11] Patent Number: 5,972,197

[45] Date of Patent: Oct. 26, 1999

[54] METHOD FOR PRODUCING POLYSULFIDES BY ELECTROLYTIC OXIDATION

[75] Inventors: Tatsuya Andoh, Kawasaki; Tetsuji Shimohira; Eiji Endoh, both of Yokohama, all of Japan

[73] Assignees: Asahi Glass Company Ltd.; Kawasaki Kasei Chemicals Ltd., both of Tokyo, Japan

[21] Appl. No.: 08/973,756

[22] PCT Filed: Apr. 25, 1997

[86] PCT No.: PCT/JP97/01456

§ 371 Date: Dec. 23, 1997

§ 102(e) Date: Dec. 23, 1997

[87] PCT Pub. No.: WO97/41295

PCT Pub. Date: Nov. 6, 1997

[30] Foreign Application Priority Data

Apr. 26, 1996 [JP] Japan ..... 8-107335

[51] Int. Cl.[6] ..... C25B 1/00; C01B 17/18

[52] U.S. Cl. ..... 205/554; 423/562

[58] Field of Search ..... 205/554, 617; 423/571, 562

[56] References Cited

U.S. PATENT DOCUMENTS 4,108,757 8/1978 Fleet et al. ..... 204/294

FOREIGN PATENT DOCUMENTS

95/00701 1/1995 WIPO .

*Primary Examiner*—Bruce F. Bell
*Assistant Examiner*—Edna Wong
*Attorney, Agent, or Firm*—Oblon, Spivak, McClelland, Maier & Neustadt, P.C.

[57] ABSTRACT

A method for producing polysulfides, which comprises introducing a solution containing sulfide ions into an anode compartment of an electrolytic cell comprising the anode compartment provided with a porous anode, of which at least the surface is made of carbon, a cathode compartment provided with a cathode, and a diaphragm partitioning the anode compartment and the cathode compartment, and carrying out electrolytic oxidation to obtain polysulfide ions.

18 Claims, No Drawings

METHOD FOR PRODUCING POLYSULFIDES BY ELECTROLYTIC OXIDATION

This is a national stage application of PCT/JP97/01456 filed Apr. 25, 1997.

TECHNICAL FIELD

The present invention relates to a method for producing polysulfides by electrolytic oxidation. Particularly, it relates to a method for producing a polysulfide cooking liquor by electrolytically oxidizing white liquor in a pulp production process.

BACKGROUND ART

It is important to increase the yield of chemical pulp for effective utilization of wood resources. A polysulfide cooking process is one of the techniques to increase the yield of kraft pulp as the most common type of chemical pulp.

The cooking liquor for the polysulfide cooking process is produced by oxidizing an alkaline aqueous solution containing sodium sulfide, i.e. so-called white liquor, by molecular oxygen such as air in the presence of a catalyst such as active carbon (e.g. reaction formula 1) (JP-A-61-259754 and JP-A-53-92981). By this method, a polysulfide cooking liquor having a polysulfide sulfur concentration of about 5 g/l can be obtained at a selectivity of about 60% and a conversion of 60% based on the sulfide ions. Here, polysulfide sulfur which may also be referred to as PS-S, is meant for sulfur of 0 valency in e.g. sodium polysulfide $Na_2S_x$, i.e. sulfur of (x−1) atom. Further, the sulfide ion composing polysulfide ion which may also be referred to as $Na_2S$ as S, is meant for sulfur corresponding to sulfur having oxidation number of −2 in the polysulfide ions, or sulfur of one atom per $S_x^{2-}$. Further, in this specification, the unit liter for the volume will be represented by l. However, by this air oxidation method, thiosulfate ions not useful for cooking, are likely to form by side reactions (e.g. reaction formulas 2 and 3), whereby it used to be difficult to produce a polysulfide cooking liquor at a high PS-S concentration with a high selectivity.

$$4Na_2S+O_2+2H_2O \rightarrow 2Na_2S_2+4NaOH \quad (1)$$

$$2Na_2S+2O_2+H_2O \rightarrow Na_2S_2O_3+2NaOH \quad (2)$$

$$2Na_2S_2+3O_2 \rightarrow 2Na_2S_2O_3 \quad (3)$$

On the other hand, PCT International Publication WO95/00701 discloses a method for electrolytically producing a polysulfide cooking liquor. In this method, as an anode, an electrode substrate surface-coated with one or more oxides of ruthenium, iridium, platinum and palladium, is used. Specifically, a three-dimensional mesh electrode composed of a plurality of expanded-metal layers is disclosed as the anode.

DISCLOSURE OF INVENTION

It is an object of the present invention to obtain highly concentrated polysulfides by an electrolytic method from sulfide ions in a solution, particularly to produce cooking liquor having highly concentrated polysulfide sulfur from white liquor in a pulp production process at high selectivity with low electric power while minimizing by-production of thiosulfate ions.

The present invention provides a method for producing polysulfides, which comprises introducing a solution containing sulfide ions into an anode compartment of an electrolytic cell comprising the anode compartment provided with a porous anode, of which at least the surface is made of carbon, a cathode compartment provided with a cathode, and a diaphragm partitioning the anode compartment and the cathode compartment, and carrying out electrolytic oxidation to obtain polysulfide ions.

In the present invention, carbon material is used for at least the surface portion of the anode, whereby the anode has practically adequate durability in the production of polysulfides. Carbon exhibits adequate electrical conductivity as an anode, whereby IR (resistance) drop at the anode can be reduced. Further, the anode used in the present invention has good electrical conductivity and is a porous structure with a large surface area, whereby the desired electrolytic reaction takes place over the entire surface of the electrode thereby to suppress formation of by-products.

BEST MODE FOR CARRYING OUT THE INVENTION

The anode is required to be made of carbon at least at its surface. Namely, the entire anode may be made of a carbon, or carbon may be coated on the surface of a substrate made of other than carbon. It is particularly preferred to use a porous body made of integrated carbon fibers as the anode, whereby a sufficient surface area can be obtained, and an anode having a large porosity which facilitates liquid passage, can be obtained. Specifically, carbon fibers integrated in a felt form, a non-woven fabric of carbon fibers or a woven fabric of carbon fibers, is preferred. A porous anode may be formed by packing carbon particles, into the anode compartment. Further, a carbon material having a three dimensional network structure e.g. reticulated glassy carbon may be used as the anode.

The surface area of the anode is preferably from 10 to 5000 $m^2/m^2$ of the effective area of the diaphragm partitioning the anode compartment and the cathode compartment (hereinafter referred to simply as the diaphragm area).

If the surface area is less than 10 $m^2/m^2$ of the diaphragm area, the current density at the anode surface tends to be large, whereby by-products such as thiosulfate ions are likely to form, such being undesirable. If it is attempted to increase the surface area of the anode beyond 5000 $m^2/m^2$ of the diaphragm area, it will be required to pack a larger amount of the anode into the anode compartment, whereby there will be a problem in the electrolytic operation such that the pressure loss of the liquid tends to be large. More preferably, the surface area of the anode is from 30 to 1000 $m^2/m^2$ of the diaphragm area. Even when pores are present inside of the anode, it is practically negligible that the solution diffuses into the interior of the pores so that an electrode oxidation reaction takes place. Accordingly, only the apparent surface may be regarded as contributing to the reaction. For example, in a case where the anode is an integrated body of carbon fibers, the surface area is the one obtainable by calculation from the diameter and the total length of the fibers on the assumption that the carbon fibers have a smooth surface. In a case where the anode is in the form of particles such as active carbon particles, the surface area can be obtained from the diameter of a particle having an average particle size and the number of particles packed.

In a case where an integrated body of carbon fibers is used as the anode, the diameter of the carbon fibers is preferably from 1 to 300 $\mu$m. Carbon fibers having a diameter of less than 1 $\mu$m are difficult to produce and costly and not easy to handle. If the diameter exceeds 300 $\mu$m, it tends to be difficult to obtain an anode having a large surface area, and the current density at the surface of the anode tends to be large, whereby by-products such as thiosulfate ions are likely to form, such being undesirable. The diameter of carbon fibers is more preferably from 5 to 50 $\mu$m.

The carbon fibers are preferably integrated for use as an anode in the form of a felt so that the surface area per the diaphragm area will be within the above-mentioned range. The amount of carbon fibers per unit area of the diaphragm is preferably from 50 to 3000 g/m$^2$. If the amount of carbon fibers increases, the pressure loss of the liquid in the anode compartment tends to be large, such being undesirable. If the amount is small, it tends to be difficult to obtain a large anode surface area.

The method for producing carbon fibers is not particularly limited, and conventional PAN-type, pitch-type or cellulose-type fibers may be used. To obtain high electrical conductivity, the carbon content is preferably at least 90 wt %.

In the present invention, the anode is preferably packed fully in the anode compartment until it is in contact with the diaphragm. It is necessary that the solution containing sulfide ions will pass through the anode. Accordingly, the anode formed by packing is preferably porous structures and has a sufficient porosity. The porosity of the anode structure is preferably from 70 to 98% in a state where it is fully packed in the anode compartment. If the porosity is less than 70%, the pressure loss at the anode tends to be large, such being undesirable. If the porosity exceeds 98%, it tends to be difficult to have a large anode surface area. The porosity is more preferably from 80 to 95%.

An electric current is supplied to the anode through an anode current collector, the material for the current collector is preferably a material excellent in alkali resistance. For example, nickel, titanium, carbon, gold, platinum or stainless steel may, for example, be employed. The surface of the current collector may be flat. It may be designed to supply an electric current simply by mechanical contact with the anode.

The material for the cathode is preferably a material having alkali resistance, and nickel, Raney nickel, nickel sulfide, steel or stainless steel may, for example, be used. As the cathode, one or more flat plates or meshed sheets may be used in a single or a multi-layered structure. Otherwise, a three dimensional electrode composed of linear electrodes, may also be employed. As the electrolytic cell, a two compartment type electrolytic cell comprising one anode compartment and one cathode compartment, may be employed. An electrolytic cell having three or more compartments combined may also be used. A plurality of electrolytic cells may be arranged in a monopolar structure or a bipolar structure.

As the diaphragm for partitioning the anode compartment and the cathode compartment, it is preferred to employ a cation exchange membrane. The cation exchange membrane will transport cations from the anode compartment to the cathode compartment and will prevent transfer of sulfide ions and polysulfide ions. As the cation exchange membrane, a polymer membrane having cation exchange groups such as sulfonic acid groups or carboxylic acid groups introduced to a hydrocarbon type or fluorine type polymer, is preferred. If there is no problem with respect to alkali resistance, a bipolar membrane or an anion exchange membrane may also be used.

The anode potential is preferably maintained within a range that polysulfide ions ($S_x^{2-}$) such as $S_2^{2-}$, $S_3^{2-}$, $S_4^{2-}$ and $S_5^{2-}$ will form as oxidation products of sulfide ions, and no thiosulfate ions will be produced as by-products. The operation is preferably carried out so that the anode potential will be within a range of from −0.75 to +0.25 V. If the anode potential is lower than −0.75 V, no formation of polysulfide ions will substantially take place, such being undesirable. If the anode potential is higher than +0.25 V, by-products such as thiosulfate ions are likely to form, such being undesirable. In the present specification, the electrode potential is represented by a potential measured against a reference electrode of $Hg/Hg_2Cl_2$ in a saturated KCl solution at 25° C.

The anode to be used in the present invention has a three-dimensional structure. Accordingly, it is not easy to accurately measure the anode potential. Accordingly, rather than controlling the production condition by regulating the potential, it is industrially preferred to control the production condition by regulating the cell voltage or the current density at the diaphragm area. This electrolytic method is suitable for constant current electrolysis. However, it is possible to change the current density.

It is preferred that the operation is carried out at a current density of from 0.5 to 20 kA/m$^2$ of the diaphragm area i.e. the effective area through which an electric current actually flows. If the current density at the diaphragm area is less than 0.5 kA/m$^2$, an unnecessarily large installation for electrolysis will be required, such being undesirable. If the current density at the diaphragm area exceeds 20 kA/m$^2$, deterioration of the anode will be accelerated, and by-products such as thiosulfate ions, sulfate ions and oxygen may increase, such being undesirable. More preferably, the current density at the diaphragm area is from 2 to 15 kA/m$^2$.

In the present invention an anode having a large surface area relative to the diaphragm area, is employed, whereby the operation can be carried out within a range where the current density at the anode surface is small. Presuming that the current density is uniform over the entire surface of the anode, if the current density at the anode surface is calculated from the surface area of the anode, the calculated current density is preferably from 0.1 to 600 A/m$^2$, more preferably from 10 to 300 A/m$^2$. If the current density at the anode surface is less than 0.1 A/M$^2$, an unnecessarily large installation for electrolysis will be required, such being undesirable. If the current density at the anode surface exceeds 600 A/m$^2$, deterioration of the anode will be accelerated, and by-products such as thiosulfate ions, sulfate ions and oxygen may increase, such being undesirable.

In the present invention, counter cations for sulfide ions and polysulfide ions are preferably alkali metal ions. The alkali metal is preferably sodium or potassium.

The method of the present invention is suitable particularly for a method for obtaining a sodium polysulfide cooking liquor by electrolytic oxidation white liquor in a pulp production process. When a polysulfide production process of the present invention is combined in the pulp production process, at least a part of white liquor is withdrawn and treated by the polysulfide production process of the present invention, and the treated liquor is supplied to a cooking process.

The composition of the white liquor usually contains from 2 to 6 mol/l of alkali metal ions in the case of white liquor used for current kraft pulp cooking, and at least 90% thereof is sodium ions, the rest being substantially potassium ions. Anions are mainly hydroxide ions, sulfide ions and carbonate ions and further include sulfate ions, thiosulfate ions and chlorine ions. Further, very small amount components such as silicon, aluminum, phosphorus, magnesium, copper, manganese and iron, are contained. When such white liquor is supplied to the anode compartment of the present invention and subjected to electrolytic oxidation, the sulfide ions are oxidized to form polysulfide ions. At the same time, alkali metal ions will be transported through the diaphragm to the cathode compartment.

To be useful for the pulp cooking process, the polysulfide sulfur concentration in the solution (the polysulfide cooking liquor) obtained by electrolysis of the white liquor is preferably from 5 to 15 g/l, although it depends also on the sulfide ion concentration in the white liquor. If the polysulfide sulfur concentration is less than 5 g/l, no adequate effect for increasing the yield of pulp by cooking may sometimes be obtained. If the PS-S concentration is larger than 15 g/l, $Na_2S$ as S tends to be small, whereby the yield of pulp will not increase, and thiosulfate ions tend to be produced as by-products during the electrolysis. Further, if the average value of x of the polysulfide ions ($S_x^{2-}$) exceeds 4, thiosulfate ions likewise tend to be formed as by-products during the electrolysis. Accordingly, it is preferred to carry out the operation of electrolysis so that the average value of x of the polysulfide ions in the cooking liquor will be at most 4, preferably at most 3.5.

The white liquor introduced into the anode compartment is treated usually by one pass or by recycling. However, it is preferred to produce a polysulfide cooking of high concentration PS-S liquor by one pass treatment. In the case of recycling treatment, not only the pump capacity tends to be unnecessarily large, but also the heat history of the polysulfide cooking liquor increases, and PS-S tends to undergo thermal decomposition. The conversion of the sulfide ions to polysulfide ions is preferably from 15 to 75%.

The reaction at the cathode in the cathode compartment may be selected. However, it is preferred to utilize a reaction to form hydrogen gas from water. From the hydroxide ion formed as a result and the alkali metal ion transported from the anode compartment, an alkali metal hydroxide will be formed. The solution introduced into the cathode compartment is preferably the one consisting essentially of water and an alkali metal hydroxide, particularly sodium or potassium hydroxide. The concentration of the alkali metal hydroxide is not particularly limited, but is usually from 1 to 15 mol/l, preferably from 2 to 5 mol/l. It is possible to prevent deposition of precipitates inside the diaphragm if a solution having an ion intensity lower than the ion intensity of the white liquor passing through the anode compartment is used as the cathode solution although such may depend on the particular case.

The temperature of the anode compartment is preferably from 60 to 110° C. If the temperature of the anode compartment is lower than 60° C., the cell voltage tends to be high, and the concentration of by-products tends to be high. The upper limit of the temperature is practically limited by the material of the diaphragm or the electrolytic cell.

In the present invention, the average superficial velocity of the solution in the anode compartment is preferably from 0.1 to 30 cm/s in order to minimize the pressure loss. The flow rate of the cathode solution is not particularly limited and is determined depending upon the degree of buoyancy of the generated gas.

Now, the present invention will be described in further detail with reference to Examples. However, it should be understood that the present invention is by no means restricted to such specific Examples.

EXAMPLE 1

A two compartment electrolytic cell was assembled by using a nickel plate as an anode current collector, a carbon felt as an anode, a Raney nickel electrode as a cathode, and a fluorinated type cation exchange membrane (FREMION, tradename, manufactured by Asahi Glass Company Ltd.) as a diaphragm. The anode compartment and the cathode compartment were rectangular parallelopiped of the same size (each having a height of 100 mm, a width of 20 mm and a thickness of 5 mm), and the diaphragm area was 20 $cm^2$. The carbon felt used as the anode had a size of 100 mm×20 mm and an initial thickness of 8 mm. Such a carbon felt was packed into the anode compartment, and the cathode was pressed against the diaphragm from the cathode compartment side, so that the thickness of the carbon felt became 5 mm.

The physical properties of the anode as packed in the anode compartment were as follows.

Diameter of carbon fibers: 12 $\mu$m

Surface area to diaphragm area: 140 $m^2/m^2$

Weight to diaphragm area: 620 $g/m^2$

Porosity: 92%

As an anode solution, 1 l of model white liquor ($Na_2S$: 16 g/l as calculated as sulfur atom, NaOH: 90 g/l, $Na_2CO_3$: 34 g/l) was prepared in a glass vessel, and this model white liquor was circulated at a flow rate of 80 ml/min during the electrolytic operation. The anode solution was introduced into the anode compartment from the lower side and withdrawn from the upper side of the anode compartment. 2 l of a 3N NaOH aqueous solution was used as a cathode solution, and it was circulated at a flow rate of 80 ml/min in the same manner of anode side.

Constant current electrolysis was carried out at a current of 8 A (current density per diaphragm area: 4 $kA/m^2$) at a liquid temperature of 90° C. to prepare a polysulfide solution. The circulated liquid (the anode solution in the vessel) was sampled every predetermined interval, the polysulfide sulfur, the $Na_2S$ as S and thiosulfate ions in the solution were quantitatively analyzed, and the concentrations are shown in Table 1 as calculated as sulfur atom. In Table 1, the respective values are shown in the columns for PS-S, $Na_2S$ and $Na_2S_2O_3$. The analyses were carried out in accordance with the methods disclosed in JP-A-7-92148. The difference in the $Na_2S$ concentration of the model white liquor between the prepared solution and an analyzed solution at electrolysis time of 0 is considered to be attributable to some water mixed at the time of introducing the white liquor into the electrolytic cell and an analytical error. Throughout the electrolytic operation of each of Examples 1 to 8, no formation of sulfate ions and no generation of oxygen was observed. The potential of the anode current collector and the cell voltage were measured and shown in Table 1. After two hours of operation, the polysulfide solution containing the PS-S concentration of 9.4 g/l was obtained, and the selectivity at that time was 95%, the current efficiency was 91%, and the average value of x of the polysulfide ions ($S_x^{2-}$) was 3.8.

The selectivity and the current efficiency are defined by the following formulae, wherein A is the PS-S concentration (g/l), and B is the concentration of increment thiosulfate ions, as calculated as sulfur atom (g/l).

$$Selectivity=(A/(A+B))\times 100\%$$

$$Current\ efficiency=(A/(A+2B))\times 100\%$$

TABLE 1

| Electrolysis time | Concentration as calculated as sulfur (g/l) | | | Anode current collector potential | Cell voltage |
|---|---|---|---|---|---|
| (min) | PS–S | $Na_2S$ | $Na_2S_2O_3$ | (V) | (V) |
| 0 | 0.0 | 13.3 | 0.22 | −0.59 | 1.03 |
| 15 | 1.0 | 12.2 | 0.24 | −0.59 | 1.03 |
| 30 | 2.2 | 10.8 | 0.26 | −0.61 | 1.01 |
| 45 | 3.5 | 9.8 | 0.33 | −0.63 | 1.00 |
| 60 | 4.2 | 8.2 | 0.39 | −0.63 | 1.00 |
| 75 | 5.9 | 7.1 | 0.46 | −0.64 | 1.00 |
| 90 | 7.2 | 5.7 | 0.52 | −0.64 | 1.01 |
| 105 | 8.5 | 4.5 | 0.49 | −0.62 | 1.04 |
| 120 | 9.4 | 3.4 | 0.69 | −0.53 | 1.12 |

EXAMPLE 2

Constant current electrolysis was carried out in the same manner as in Example 1 except that the current was changed to 12 A (current density per diaphragm area: 6 kA/$m^2$), and the flow rate of anolyte was changed to 120 ml/min. As shown in Table 2, after 90 minutes of operation, a polysulfide solution containing a PS-S concentration of 10.5 g/l was obtained, and the selectivity at that time was 94%, the current efficiency was 88%, and the average value of x of the polysulfide ions ($S_x^{2-}$) was 2.9.

TABLE 2

| Electrolysis time | Concentration as calculated as sulfur (g/l) | | | Anode current collector potential | Cell voltage |
|---|---|---|---|---|---|
| (min) | PS–S | $Na_2S$ | $Na_2S_2O_3$ | (V) | (V) |
| 0 | 0.0 | 16.7 | 0.22 | −0.56 | 1.32 |
| 10 | 1.0 | 15.7 | 0.28 | −0.58 | 1.27 |
| 20 | 2.1 | 14.4 | 0.33 | −0.60 | 1.26 |
| 30 | 3.2 | 12.8 | 0.43 | −0.61 | 1.26 |
| 40 | 4.4 | 11.4 | 0.51 | −0.61 | 1.27 |
| 50 | 5.6 | 10.3 | 0.60 | −0.62 | 1.29 |
| 60 | 6.9 | 9.1 | 0.69 | −0.62 | 1.29 |
| 70 | 8.1 | 7.9 | 0.76 | −0.62 | 1.32 |
| 80 | 9.4 | 6.7 | 0.84 | −0.61 | 1.35 |
| 90 | 10.5 | 5.5 | 0.92 | −0.59 | 1.40 |

EXAMPLE 3

Constant current electrolysis was carried out in the same manner as in Example 1 except that the current was changed to 16 A (current density per diaphragm area: 8 kA/$m^2$), and the flow rate of anolyte was changed to 170 ml/min. As a result, as shown in Table 3, after 75 minutes of operation, the polysulfide solution containing the PS-S concentration of 11 g/l was obtained, and the selectivity at that time was 91%, the current efficiency was 84%, and the average value of x of the polysulfide ions ($S_x^{2-}$) was 3.3.

TABLE 3

| Electrolysis time | Concentration as calculated as sulfur (g/l) | | | Anode current collector potential | Cell voltage |
|---|---|---|---|---|---|
| (min) | PS–S | $Na_2S$ | $Na_2S_2O_3$ | (V) | (V) |
| 0 | 0.0 | 15.3 | 0.22 | −0.53 | 1.54 |
| 7.5 | 1.0 | 14.0 | 0.32 | −0.56 | 1.51 |
| 15 | 2.1 | 13.0 | 0.42 | −0.57 | 1.50 |
| 22.5 | 3.2 | 11.9 | 0.52 | −0.58 | 1.51 |
| 30 | 4.4 | 10.6 | 0.53 | −0.59 | 1.52 |
| 37.5 | 5.7 | 9.7 | 0.64 | −0.59 | 1.55 |
| 45 | 7.0 | 8.5 | 0.70 | −0.59 | 1.57 |
| 52.5 | 8.0 | 7.4 | 0.74 | −0.58 | 1.60 |
| 60 | 9.5 | 6.5 | 0.84 | −0.57 | 1.64 |
| 67.5 | 10.3 | 5.4 | 0.99 | −0.55 | 1.68 |
| 75 | 11.0 | 4.7 | 1.27 | −0.47 | 1.77 |

EXAMPLE 4

The thickness of the anode compartment of the electrolytic cell used in Example 1 was set to be 4 mm, and an anode (carbon felt) having a thickness of 9 mm was packed and compressed into the anode compartment to obtain an electrolytic cell. The physical properties of the anode as packed into the anode compartment were as follows.

Diameter of carbon fibers: 12 $\mu$m

Surface area to diaphragm area: 158 $m^2/m^2$

Weight to diaphragm area: 698 g/$m^2$

Porosity: 89%

The same model white liquor as used in Example 1 was employed as an anode solution, and constant current electrolysis was carried out in the same manner as in Example 1 at a current of 12 A (current density per diaphragm area: 6 kA/$m^2$) and at a flow rate of the anode solution of 48 ml/min (the superficial velocity of the anode solution: 1.0 cm/s).

After one hour and thirty minutes of operation, the composition of the polysulfide solution was such that the PS-S concentration was 12.6 g/l, the $Na_2S$ as S concentration was 4.1 g/l, and the increased thiosulfate ions were 0.37 g/l as calculated as sulfur atom. The current efficiency at that time was 94%, the selectivity was 97%, and the average value of x of the polysulfide ions ($S_x^{2-}$) was 4.1. During the electrolysis, the cell voltage was stable at about 1.3 V. When the electrolysis was further continued, the cell voltage tended to increase, the PS-S concentration tended to decrease, and the thiosulfate ion concentration tended to increase.

EXAMPLE 5

The thickness of the anode compartment of the electrolytic cell used in Example 1 was set to be 1 mm, and an anode (carbon felt) having a thickness of 2 mm was packed and compressed into the anode compartment to obtain an electrolytic cell. The physical properties of the anode as packed into the anode compartment were as follows.

Diameter of carbon fibers: 12 $\mu$m

Surface area to diaphragm area: 35 $m^2/m^2$

Weight to diaphragm area: 155 g/$m^2$

Porosity: 90%

The same model white liquor as used in Example 1 was employed as an anode solution, and constant current electrolysis was carried out in the same manner as in Example 1 at a current of 12 A (current density per diaphragm area: 6 kA/$m^2$) and at a flow rate of the anode solution of 24 ml/min (the superficial velocity of the anode solution: 2.0 cm/s).

After 50 minutes of operation, the polysulfide solution at the outlet of the cell was sampled and quantitatively analyzed, whereby the composition of the polysulfide solution was such that the PS-S concentration was 10.5 g/l, the $Na_2S$ as S concentration was 5.1 g/l, and the increased thiosulfate ions were 0.74 g/l as sulfur atom. The current efficiency was 88%, the selectivity was 93%, and the average value of x of the polysulfide ions ($S_x^{2-}$) was 3.1. During the electrolysis, the cell voltage was stable at a level of about 1.4 V.

EXAMPLE 6

Into the anode compartment of the electrolytic cell used in Example 4, spherical active carbon having an average particle size of 0.71 mm (Kureha Beads Active Carbon G-BAC70R, tradename, manufactured by Kureha Chemical Industries Co., Ltd.) was packed to prepare an electrolytic cell provided with an active carbon anode having the following physical properties. The surface area of the active carbon was calculated from the average particle size of beads.

Surface area to diaphragm area: 25 $m^2/m^2$

Weight to diaphragm area: 2300 g/$m^2$

Porosity: 33%

The same model white liquor as used in Example 1 was employed as the anode solution, and constant current electrolysis was carried out in the same manner as in Example 1 at a current of 12 A (current density at the diaphragm: 6 kA/$m^2$) at a flow rate of the anode solution of 120 ml/min (the superficial velocity of the anode solution: 2.5 cm/s).

After 90 minutes of operation, the composition of the polysulfide solution was such that the PS-S concentration was 8.8 g/l, the $Na_2S$ as S concentration was 6.3 g/l, and the increased thiosulfate ions were 1.1 g/l as calculated as sulfur atom. The current efficiency at that time was 80%, the selectivity was 89%, and the average value of x of the polysulfide ions ($S_x^{2-}$) was 2.4. During the electrolysis, the cell voltage was stable at a level of about 1.6 V.

EXAMPLE 7

Constant current electrolysis was carried out in the same manner as in Example 1. 1 l of white liquor practically used in a pulp plant was employed as the anode solution ($Na_2S$: 15.5 g/l as calculated as sulfur atom, NaOH: 93.6 g/l, $Na_2CO_3$: 36.9 g/l, $Na_2S_2O_3$: 2.25 g/l as calculated as sulfur atom, $Na_2SO_3$: 0.1 g/l as calculated as sulfur atom).

The thickness of the anode compartment was 4 mm, the anode (carbon felt) having a thickness of 6 mm was packed into the anode compartment, and the flow rate of the anode solution was 24 ml/min (superficial velocity of the anode solution: 0.5 cm/s).

The physical properties of the anode as packed in the anode compartment were as follows.

Diameter of carbon fibers: 12 $\mu$m

Surface area to diaphragm area: 105 $m^2/m^2$

Weight to diaphragm area: 465 g/$m^2$

Porosity: 92.5%

After 50 minutes of operation, the polysulfide solution at the outlet of the cell was sampled and quantitatively analyzed, whereby the composition of the polysulfide solution was such that the PS-S concentration was 11.0 g/l, the $Na_2S$ as S concentration was 4.9 g/l, the thiosulfate ions was 3.01 g/l as calculated as sulfur atom, and the average value of x of the polysulfide ions ($S_x^{2-}$) was 3.2. During the electrolysis, the cell voltage was stable at a level of 1.4 V.

This white liquor contained sulfite ions, as it is the white liquor practically used in a pulp plant. The sulfite ions react with polysulfide ions as shown in the following reaction formula 4 to form thiosulfate ions.

$$Na_2S_x+(x-1)Na_2SO_3 \rightarrow Na_2S+(x-1)Na_2S_2O_3 \quad (4)$$

Accordingly, the actual current efficiency and the selectivity were 91% and 95%, respectively, as calculated by the following formulas.

0.1: PS-S concentration reduced by sulfite ions 0.2: Thiosulfate ions concentration, as calculated as sulfur atom, formed by the reaction of the sulfite ions with PS-S.

Current efficiency: $(11.0+0.1)\div((11.0+0.1)+(3.01-2.25-0.2)\times 2)=0.91$

Selectivity: $(11.0+0.1)\div((11.0+0.1)+(3.01-2.25-0.2))=0.95$

EXAMPLE 8

In the electrolytic cell used in Example 7, nickel sulfide was used as the cathode to prepare an electrolytic cell. The physical properties of the anode as packed in the anode compartment were as follows.

Diameter of carbon fibers: 12 $\mu$m

Surface area to diaphragm area: 105 $m^2/m^2$

Weight to diaphragm area: 465 g/$m^2$

Porosity: 92.5%

A 1 l circulation tank for the anode solution (the polysulfide solution) and cathode solution (an aqueous NaOH solution) were prepared. The anode solution was circulated and electrolyzed, at the same time, a predetermined amount of white liquor was fed into the anode circulation tank, the polysulfide solution was overflowed from the circulation tank in order to maintain the amount of the circulation liquid and PS-S concentration to be constant. Likewise, the cathode solution was circulated and electrolyzed. At the same time, a predetermined amount of water was fed into the cathode circulation tank, the aqueous NaOH solution was overflowed from the circulation tank in order to maintain the amount of the circulation liquid and NaOH concentration to be constant. The NaOH in the cathode solution was formed from $Na^+$ moved through the anode solution and $OH^-$ produced by the decomposed cathode water. Consequently, the liquid compositions in the anode circulation tank and the cathode circulation tank were maintained to be constant, and the electrolytic condition was kept steady state, so that a change in the cell voltage, etc. due to a change in the compositions of the electrolytic solutions was prevented, it is possible to observe a change in the cell voltage due to a change of a performance of the electrodes and the membrane.

As the residence time of the anode solution in the circulation tank is long, in order to prevent the degradation of the polysulfide ions by heating, heat exchangers were attached at the inlet and outlet lines of the electrolytic cell, and the anode solution in the circulation tank was maintained at room temperature, and only the anode solution flowing through the electrolytic cell was maintained at 90° C. Similar heat exchangers were attached also on the cathode side.

As the anode solution, white liquor practically used in a pulp plant ($Na_2S$: 17.9 g/l as calculated as sulfur atom, NaOH: 93.6 g/l, $Na_2CO_3$: 36.9 g/l, $Na_2S_2O_3$: 1.5 g/l as calculated as sulfur atom, $Na_2SO_3$: 0.3 g/l as calculated as sulfur atom) was used, and continuous constant current electrolysis was carried out for about one month at a current of 12 A (current density at the diaphragm: 6 kA/$m^2$). A flow rate of the anode solution was 48 ml/min (superficial velocity of the anode solution: 1.0 cm/s), a flow rate of the cathode solution as 80 ml/min, a feeding rate of white liquor was 15 ml/min, and a feeding rate of water was 2.0 ml/min.

As a result, the cell voltage was from 1.3 to 1.4 V and the anode current collector potential was about −0.6 V, and the cathode potential was constant at a level of −1.8 V.

After one month of operation, the composition of the anode solution was as follows: PS-S concentration: 7.9 g/l, $Na_2S$ as S concentration: 9.6 g/l and thiosulfate ions as sulfur atom: 2.4 g/l. As described in Example 7, the current efficiency and the selectivity were calculated considering the concentration of sulfide ions. Then, by the following formulas, the current efficiency was 93%, and the selectivity was 96%. Thus, excellent current efficiency and selectivity were maintained for a month.

Current efficiency: $(7.9+0.3)\div((7.9+0.3)+(2.4-1.5-0.6)\times 2)=0.93$

Selectivity: $(7.9+0.3)\div((7.9+0.3)+(2.4-1.5-0.6))=0.96$

Further, the composition of the polysulfide solution at the outlet of the cell was as follows: PS-S concentration: 10.2 g/l, $Na_2S$ as S concentration: 7.2 g/l and thiosulfate ions as sulfur atom: 2.5 g/l.

COMPARATIVE EXAMPLE 1

In the electrolytic cell as used in Example 1, a three dimensional meshed dimensionally stable electrode (DSA) was used as the anode, and the thickness of the anode compartment was set to be 2 mm. 1 l of the same model white liquor as used in Example 1 was prepared as the anode solution, and constant current electrolysis was carried out in the same manner as in Example 1 at a current of 12 A (current density at the diaphragm: 6 kA/$m^2$) and at a flow rate of the anode solution of 480 ml/min (superficial velocity of the anode solution: 20 cm/s).

The cell voltage continuously increased during the electrolysis operation and exceeded a level of 2.5 V. Further, from the anode side, oxygen was generated, and after 30 minutes of operation, an increase of sulfate ions was confirmed. After one hour and thirty minutes of operation, the composition of the polysulfide solution was such that the PS-S concentration was 5.8 g/l, the $Na_2S$ as S concentration was 8.0 g/l, the increased thiosulfate ions were 1.64 g/l as calculated as sulfur atom, the increased sulfate ions were 0.47 g/l as calculated as sulfur atom, and the current efficiency at that time was 53%, the selectivity was 73%, and the average value of x of the polysulfide ions ($S_x^{2-}$) was 1.7.

After completion of the electrolysis, fine black precipitate was observed in the polysulfide solution, and this precipitate was subjected to elemental analysis by EDX (EDAX 9100, manufactured by Japan Phillips K.K.), hereby titanium and ruthenium were detected, and it was confirmed that the anode surface was dissolved by electrolysis. In the following Comparative Examples, the same phenomenon occurred in each case.

In Comparative Examples, sulfate ions were formed as being different from Examples. The selectivity and the current efficiency were defined by the following formulas, wherein A is the PS-S concentration (g/l), B is the concentration (g/l) of increased thiosulfate ions as calculated as sulfur atom, and C is the increased sulfate ions (g/l) as calculated as sulfur atom (however, generation of oxygen is not taken into account for the current efficiency).

Selectivity; $(A/(A+B+C))\times 100\%$

Current efficiency: $(A/(A+2B+4C))\times 100\%$

COMPARATIVE EXAMPLE 2

The same electrolytic cell as used in Comparative Example 1 was employed, constant current electrolysis was carried out at a current of 12 A (current density at the diaphragm: 6 kA/$m^2$) and at a flow rate of white liquor of 3000 ml/min (superficial velocity of the anode solution: 125 cm/s).

From the initiation of the electrolysis, the cell voltage continuously increased and exceeded a level of 2 V. Further, generation of a little oxygen was confirmed from the anode side. After one hour and thirty minutes of operation, the composition of the polysulfide solution was such that the PS-S concentration was 7.8 g/l, the $Na_2S$ as S concentration was 6.2 g/l, the increased thiosulfate ions were 1.39 g/l as calculated as sulfur atom, the increased sulfate ions were 0.15 g/l as calculated as sulfur atom, and the current efficiency at that time was 70%, the selectivity was 84%, and the average value of x of the polysulfide ions ($S_x^{2-}$) was 2.3.

From the foregoing Examples and Comparative Examples, it should be understood that the present invention is excellent in the following respects.

1. According to the present invention, even if the superficial velocity of the anode solution is very small, a highly concentrated PS-S polysulfide cooking liquor can be produced at a low voltage and high current efficiency. In the Comparative Examples, even when the superficial velocity of the anode solution was set far larger than the present invention, the cell voltage was higher, the current efficiency was lower, and it was impossible to obtain a solution containing a PS-S concentration equal to the present invention.

2. According to the present invention, the superficial velocity of the anode solution can be set at a low level, the flow rate of the anode solution can be made low, and even with a short electrolytic cell length, a highly concentrated PS-S polysulfide solution can be produced by one pass without employing a circulating system.

3. According to the present invention, the production of the polysulfide solution can be carried out to maintain a low voltage and high current efficiency for a long period of time.

As described in the foregoing, according to the present invention, production of thiosulfate ions as by-product is very little, and it is possible to produce a highly concentrated polysulfide cooking liquor while maintaining high selectivity. By using the polysulfide cooking liquor thus obtained, for cooking, it is possible to effectively increase the yield of pulp. Further, the cell voltage for the electrolysis can be reduced, whereby the operation cost can be maintained at a low level.

We claim:

1. A method for producing polysulfides, which comprises introducing a solution containing sulfide ions into an anode compartment of an electrolytic cell comprising the anode compartment provided with a porous anode, of which at least the surface consists essentially of carbon, a cathode compartment provided with a cathode, and a diaphragm partitioning the anode compartment and the cathode compartment, and carrying out electrolytic oxidation to obtain polysulfide ions.

2. The method according to claim 1, wherein the surface area of the anode is from 10 to 5000 $m^2/m^2$ of the effective area of the diaphragm.

3. The method according to claim 1, wherein the anode is packed in the anode compartment so that the porosity becomes from 70 to 98%.

4. The method according to claim 1, wherein the anode is an integrated body of carbon fibers having a diameter of from 1 to 300 $\mu$m.

5. The method according to claim 4, wherein the integrated body of carbon fibers is a woven fabric, a non-woven fabric or a felt made of carbon fibers.

6. The method according to claim 1, wherein the diaphragm is a fluorinated cation exchange membrane.

7. The method according to claim 1, wherein the current density in the electrolytic oxidation is from 0.5 to 20 $kA/M^2$ of the effective area of the diaphragm.

8. The method according to claim 1, wherein the solution containing sulfide ions is passed through the anode compartment at an average superficial velocity of the solution of from 0.1 to 30 cm/s.

9. The method according to claim 8, wherein the solution containing sulfide ions is passed through the anode compartment by one pass.

10. The method according to claim 1, wherein the solution containing sulfide ions is white liquor from a pulp production process.

11. A method of forming pulp, comprising:

forming polysulfides by the method of claim 1; and cooking, with a cooking liquor comprising said polysulfides, to form said pulp.

12. The method of claim 11, wherein the anode is an integrated body of carbon fibers having a diameter of from 1 to 300 $\mu$m.

13. The method of claim 11, wherein the solution containing sulfide ions is white liquor from a pulp production process.

14. A method for producing polysulfides, comprising:

electrolytically oxidizing a solution comprising sulfide ions, at a porous anode;

wherein at least the surface of said porous anode consists essentially of carbon.

15. The method of claim 14, wherein the anode is an integrated body of carbon fibers having a diameter of from 1 to 300 $\mu$m.

16. The method of claim 15, wherein the integrated body of carbon fibers is a woven fabric, a non-woven fabric or a felt.

17. The method of claim 14, wherein said solution containing sulfide ions is white liquor from a pulp production process.

18. A method of forming pulp, comprising:

forming polysulfides by the method of claim 14; and cooking, with a cooking liquor comprising said polysulfides, to form said pulp.

* * * * *